US011376706B2

(12) United States Patent
Munier et al.

(10) Patent No.: US 11,376,706 B2
(45) Date of Patent: Jul. 5, 2022

(54) ASSEMBLY AND METHOD FOR LOADING PARTS TO BE TREATED IN A SINGLE-SIDE OR DOUBLE-SIDE TREATMENT MACHINE

(71) Applicant: PBMC SA, Les Brenets (CH)

(72) Inventors: Denis Munier, Villers-le-Lac (FR); Doniphan Mollard, Le Bizot (FR)

(73) Assignee: PBMC SA, Les Brenets (CH)

( * ) Notice: Subject to any disclaimer, the term of this patent is extended or adjusted under 35 U.S.C. 154(b) by 71 days.

(21) Appl. No.: 15/733,828

(22) PCT Filed: May 21, 2019

(86) PCT No.: PCT/IB2019/054170
§ 371 (c)(1),
(2) Date: Nov. 30, 2020

(87) PCT Pub. No.: WO2019/229585
PCT Pub. Date: Dec. 5, 2019

(65) Prior Publication Data

US 2021/0197336 A1 Jul. 1, 2021

(30) Foreign Application Priority Data

May 31, 2018 (CH) ..... CH00691/18

(51) Int. Cl.

| | |
|---|---|
| ***B24B 41/00*** | (2006.01) |
| ***B24B 7/17*** | (2006.01) |
| ***B24B 37/28*** | (2012.01) |
| ***B24B 37/30*** | (2012.01) |

(52) U.S. Cl.
CPC ..... *B24B 41/005* (2013.01); *B24B 7/17* (2013.01); *B24B 37/28* (2013.01); *B24B 37/30* (2013.01)

(58) Field of Classification Search
CPC . B24B 41/005; B24B 7/17; B24B 7/228–242; B24B 37/28; B24B 37/30; B24B 37/102; B24B 37/105
USPC ..... 451/28, 289, 269, 285–288, 290, 398; 269/47, 289 r, 903, 309–310
See application file for complete search history.

(56) References Cited

U.S. PATENT DOCUMENTS 6,419,555 B1 7/2002 Goers

FOREIGN PATENT DOCUMENTS

| | | | |
|---|---|---|---|
| JP | S-62236671 | A | 10/1987 |
| JP | 2000135672 | A | 5/2000 |
| JP | 2002184725 | A | 6/2002 |
| JP | 2010228079 | A | 10/2010 |
| JP | 2012076191 | A | 4/2012 |

*Primary Examiner* — Joseph J Hail
*Assistant Examiner* — Caleb Andrew Holizna
(74) *Attorney, Agent, or Firm* — Blank Rome LLP

(57) ABSTRACT

The invention relates to an assembly for loading parts to be treated into a single-side or double-side treatment machine, comprising—a part holder in the form of a plate for holding at least one part to be treated, comprising a second side and first side, said first side being flat, and said part holder delimiting at least one through-hole forming a cell for housing at least one part to be treated, and a film mounted on the first side of the part holder opposite said through-hole, allowing said part to be treated to be held at least during the loading step.

22 Claims, 7 Drawing Sheets

ASSEMBLY AND METHOD FOR LOADING PARTS TO BE TREATED IN A SINGLE-SIDE OR DOUBLE-SIDE TREATMENT MACHINE

RELATED APPLICATIONS

This application is a national phase application of International Application No. PCT/IB2019/054170, filed on May 21, 2019, which claims the benefit of Swiss Patent Application No. CH00691/18, filed on May 31, 2018. The entire contents of these applications are hereby incorporated by reference.

TECHNICAL FIELD

The present invention relates to the field of single-side or double-side treatment machines. More specifically, the present invention relates to the step of loading these single-side or double-side treatment machines.

Single-side or double-side treatment machines can be used to perform different operations for treating the flat surface of a part, metal or otherwise, aiming in particular to adjust the flatness, surface finish and/or dimensions of the part. These techniques include:

- polishing, namely decreasing the roughness of a surface,
- lapping, namely finishing a part by abrasion so that it has a smooth, polished surface, and so that it has a precise shape,
- grinding, namely the removal of material carried out by a large number of grains of abrasive, sometimes aggregated, which act as a cutting tool,
- resurfacing, namely a machining operation carried out using fine abrasives, which is used to take a part or portion of a part to a precise dimension within a close tolerance and to obtain an excellent surface finish that will provide a low coefficient of friction,
- thickness adjustment, etc.

The invention therefore relates particularly, but not exclusively, to grinding or resurfacing, lapping and polishing machines.

The invention therefore relates to the treatment of parts, particularly but in a non-limiting manner the treatment of metal parts, particularly parts made from steel (stainless or otherwise), copper alloys, titanium, aluminum alloys, tungsten carbides, precious metals, glass, crystals, ceramics, composites, synthetic materials, natural materials, etc.

PRIOR ART

Most of the time, parts are loaded directly on the treatment machine, by placing the part holder (forming a tool in the form of a plate) on the lower plate of the machine, then placing the parts in the openings (cells) of the part holder so that the lower side of the parts is resting on the lower plate of the machine. It will be understood that this loading technique takes a significant amount of time during a full cycle of the treatment machine, which includes the following steps: loading-treatment-unloading.

A solution already exists for loading the parts off the treatment machine: all of the part holders (planet gears) intended to be positioned on the lower plate of the machine (for example a lower polishing disk) are placed on a rigid, smooth support (for example a loading pallet), and the parts are then placed in the openings of the part holders (individually or several parts per opening). Next, the support is positioned next to the lower plate of the machine and finally, each part holder loaded with its parts to be treated is slid from the support onto the plate. This method requires adaptations on the treatment machine (loading shelf, rail, etc.) and the aforementioned sliding operation is not very convenient to implement, especially in the case of thin parts, where there is a risk of the part holder bending during loading and the loss of parts, partial adhesion of the parts to the plate, etc. This solution saves time but therefore has a considerable number of drawbacks.

JP2000135672 describes a technique for filling the windows of the part holder with a rotating loader mounted above the part holder and including vertical recesses for storing the parts, these recesses being distributed so that they are positioned opposite the windows. Such a technique requires sufficient space in the machine above the part holder and is not suited to all part and part holder geometries. In addition, the geometry of a loader in particular is only suited to a given part and part holder pair.

JP2012076191 describes a technique for filling the windows of the part holder with a specific part holder, made up of two stacked plates, attached by a pivot in the center thereof, and having the same geometry and distribution of openings for accommodating the parts. In a first loading position, the relative angular position of the plates is selected so that the openings in the upper plate do not coincide with the openings in the lower plate so that a surface portion of the lower plate closes each opening in the upper plate. In this way, the parts placed in the openings in the upper plate are retained by the portion of the lower plate. The part holder is placed in this configuration in the treatment machine and the plates are then rotated so that the relative angular position thereof makes the openings in the upper plate and the lower plate coincide. In this way, the parts drop onto the lower plate of the treatment machine. This solution has the particular drawback of using an articulated part holder that can hinder the satisfactory operation of certain treatment machines. In addition, due to the presence of two stacked plates, this solution cannot be used for thin parts to be treated.

BRIEF SUMMARY OF THE INVENTION

One aim of the present invention is to propose a system and a method for loading parts in a machine for treating parts free from the limitations of the known techniques.

In particular, a solution is sought that reduces the time taken to load the parts into the machine.

A further aim of the invention is to provide a solution that is easy to implement and does not modify the pre-existing tools and installations. Finally, a solution is sought that does not detract from the quality of the treatment performed by the treatment machine.

According to the invention, these aims are achieved particularly by means of an assembly for loading parts to be treated in a single-side or double-side treatment machine comprising:

- a part holder in the form of a plate for holding at least one part to be treated, comprising a second side and a first side, said first side being flat, and said part holder defining at least one through-hole forming a cell for accommodating at least one part to be treated, and
- a film mounted on the first side of the part holder opposite said through-hole and making it possible to hold said part to be treated in said opening at least during the loading step, said film being suitable for being destroyed during the treatment by the treatment machine.

It will be understood that this solution lies in the use of a temporary supporting film, used to hold the parts placed in the windows in the part holder during loading. Said film is suitable for being destroyed by dissolving or by friction.

At the start of the treatment, the lower plate and/or the upper plate is/are set in motion. If the film is in contact with the plate, this generates friction between the film and the plate of the machine in contact with the film, which makes it possible to wear and destroy the film, the component(s) of which are naturally discharged from the treatment machine. During the rest of the treatment, the film has thus been eliminated and the parts are in direct contact with the work plate (lower plate or upper plate) depending on the customary treatment procedures.

The loading time, and therefore the downtime of the treatment operations, is thus greatly reduced. The loading time is reduced to the time taken to load the part holders in the machine, as the parts are already loaded in the part holder. The applicant company has tested that this solution makes it possible, in some cases, to reduce the time taken to load the machine sixfold, going for example from six seconds to approximately one second.

This solution further has in particular the great advantage over the prior art of not modifying the tools, namely the part holder, already used, or having to adapt the single-side or double-side treatment machine.

The invention also relates to a method for loading parts to be treated in a single-side or double-side treatment machine that includes at least one lower plate intended to come into contact with the lower side of said parts, comprising the following steps:

- providing a part holder in the form of a plate, comprising a second side and a first side, said first side being flat, and said part holder defining at least one through-hole forming a cell for accommodating one or more part(s) to be treated,
- mounting a film on the first side of the part holder opposite said through-hole, by which the film remains affixed to the part holder, said film being suitable for being destroyed during the treatment by the treatment machine,
- placing the parts to be treated in said opening or openings, on said film (each part is placed against the film, in contact with the film), by which a loading assembly loaded with parts is formed, and
- mounting said loading assembly loaded with parts directly on the lower plate of the treatment machine.

It will be understood from the above that as the solution according to the present invention makes it possible to place the parts on the part holder outside the treatment machine, a stand-alone (self-supporting) loading assembly loaded with parts is formed outside the treatment machine that must then simply be placed in the treatment machine according to the same procedure as an empty part holder, without having to devote further time to filling the part holder with parts.

It is therefore a particularly simple, cost-effective and easy-to-implement solution.

The present invention also relates to a method for treating parts in a single-side or double-side machine, comprising the loading method as described in the present document, in which, during the step of mounting said loading assembly loaded with parts directly on the lower plate of the treatment machine, the first side of the part holder is placed on the lower plate so that the film is in contact with the lower plate, and further comprising the step of treatment of said parts with said treatment machine, by which, during the starting of the treatment, the film is eliminated and the parts directly come into contact with the lower plate during the end of the treatment.

It will be understood from the above that the present solution does not result in the adaptation of the step of treating the part, and in particular in an additional step to remove or eliminate the film, which generally deteriorates during the treatment step as set out in greater detail below. In particular, it is for example the friction between the film of the loading assembly and the plate of the treatment machine in contact with this film that allows the natural and automatic removal. In the case of a treatment machine/method that uses a liquid abrasive suspension, a film that is soluble in said liquid can also be selected.

BRIEF DESCRIPTION OF THE FIGURES

Non-limiting embodiments of the invention are set out in the description, which is illustrated by the attached figures, in which.

EXAMPLE EMBODIMENT(S) OF THE INVENTION

Figure 1A:
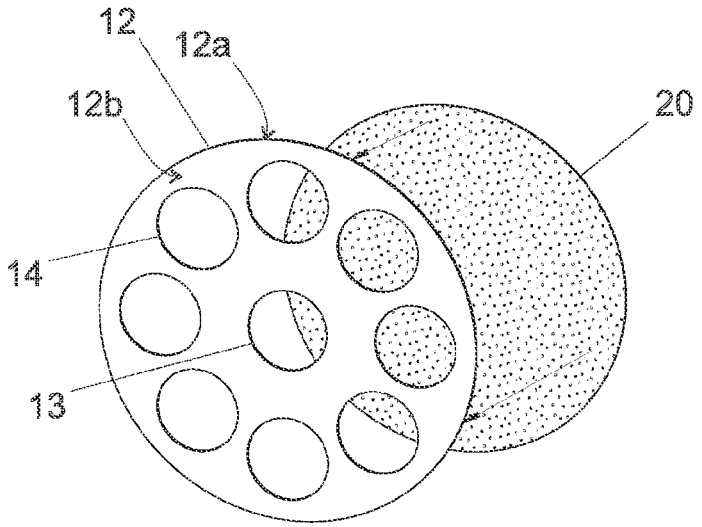
FIG. 1 (FIGS. 1A, 1B and 1C) illustrates the formation of the loading assembly according to a first embodiment.
Figure 1B:
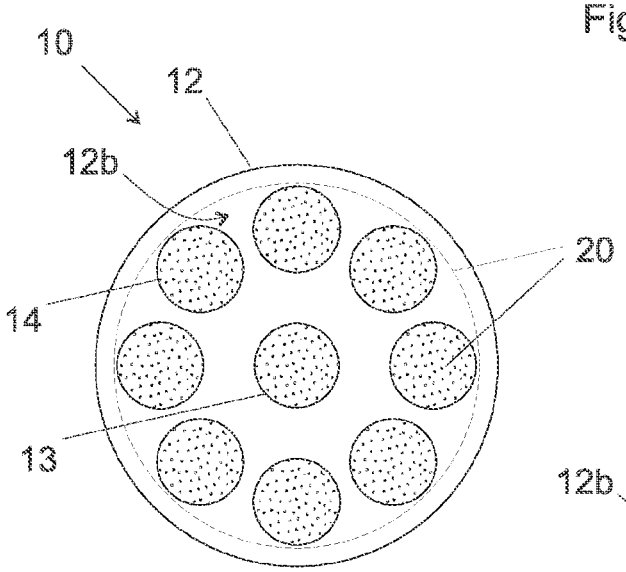
Figure 1C:
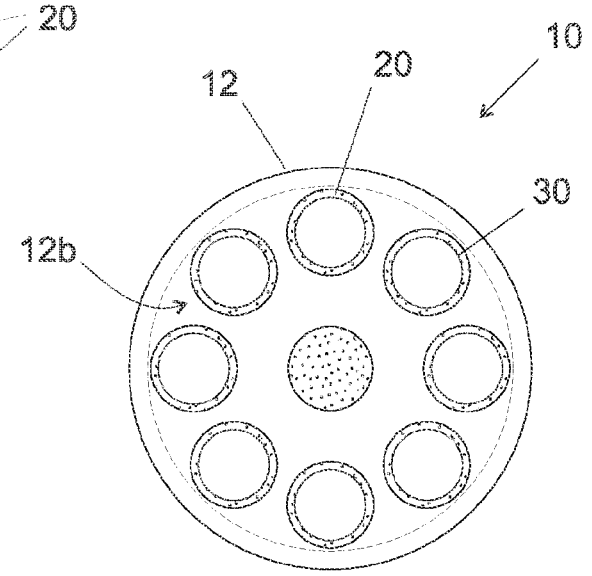

Reference is made to FIGS. 1A to 1C, which illustrate a first embodiment of the loading assembly 10 according to the invention. FIG. 1A is a perspective illustration of the mounting of a film 20 on a part holder 12 shown in a vertical position: the film 20 is affixed to the first side 12*a* of the part holder 12 (lower side or upper side during the treatment). It will be remembered that generally, the part holder forms a plate for holding the parts in position during the treatment thereof in a single-side or double-side treatment machine, and defines to this end at least one window in the form of a through-hole known as a "cell". The part holder illustrated is in the form of a disk with a central opening 13 in the center of the part holder 12 and openings 14 distributed around this central opening, in this case eight openings 14 placed every 45°.

Thus, in this non-limiting example, the part holder 12 has a circular outline and a center. Such a part holder is for example a planet gear comprising a toothed outline (not show), so as to mesh with corresponding teeth of the system for driving the part holder(s) of the lower plate of the treatment machine. According to the invention, at least the first side 12*a* is flat, in order to facilitate the placing and holding of the film 20 on this first side 12*a*. In addition, in many cases, the first side 12*a* of the part holder 12 will be placed flat on the upper side, which is also flat, of the lower plate 40 of the treatment machine. In most cases, the second side 12*b* (often intended to be facing away from the lower plate, and facing towards and placed against the upper plate for double-sided treatment) and the first side 12*a* of the part holder are parallel to each other. In the example illustrated in the figures, the part holder 12 also includes cells 14 distributed evenly about the center, but other arrangements of the cells 14 on the part holder 12 can be envisaged, as well as other shapes of the outline of the part holder, and the central opening 13 is not systematically present.

The film 20 can be formed in advance and affixed to the first side 12*a* of the part holder 12 or it can be formed directly on the first side 12*a* of the part holder 12.

In the case illustrated in FIGS. 1A, 1B, 1C and 6, the film 20 is formed in advance, then affixed (FIG. 1A) to the first side 12*a* of the part holder 12 and hold against this first side 12*a* (FIG. 1B). Depending on the respective materials used for the part holder 12 and the film 20, different methods can be used for this adhesion and holding of the film 20 fixed on the first side 12*a* of the part holder 12, for example adhesive bonding, welding, or static electricity, molecular adhesion, capillarity, etc.

In a preferred embodiment, the film 20 is made from a water-soluble material, and in this case simply moistening the first side 12*a* of the part holder 12 and/or the side of the film 20 intended to be placed on the first side 12*a* of the part holder 12 with water allows sufficient adhesion and the subsequent holding of the film 20, on contact between the film 20 and the first side 12*a* of the part holder 12.

In a preferred embodiment, the film is soluble, preferably water-soluble or oil-soluble. An example of a water-soluble film is a film made from polyvinyl acetate (PVA) or polyvinyl alcohol (PVAL), or another water-soluble resin, or a mixture of these water-soluble materials.

Figure 9:
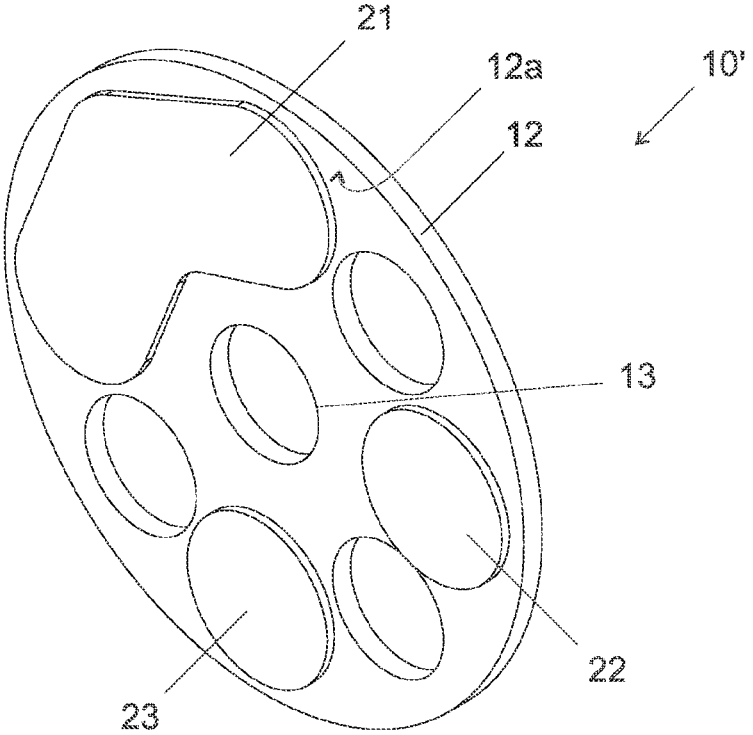
FIG. 9 illustrates a loading assembly according to a second embodiment.

In the case illustrated in FIGS. 1A, 1B and 1C, the part holder 12 includes a plurality of cells 14 and the film 20 covers all of the cells 14 in the loading assembly 10. As a variant of this loading assembly 10, according to FIG. 9, the part holder 12 includes a plurality of cells 14 and separate films cover the cells 14. In the example illustrated in FIG. 9, a limited film 21 covers two cells 14 and two individual films 22 and 23 each entirely cover a different cell 14, in order to form a loading assembly 10.

In these examples, the films 20, 21, 22 and 23 are continuous, namely solid. In other possible examples not illustrated, these films 20, 21, 22 and 23 are perforated, or discontinuous, provided that they make it possible, once fixed to the first side 12*a* of the part holder 12, to support the weight of the part 30 accommodated in the cell 14 of the part holder 12, which the presence of the film 20 makes it possible to hold during the different handling operations prior to treatment in the machine. It can be an open net structure, with openings, woven or otherwise.

Figure 10:
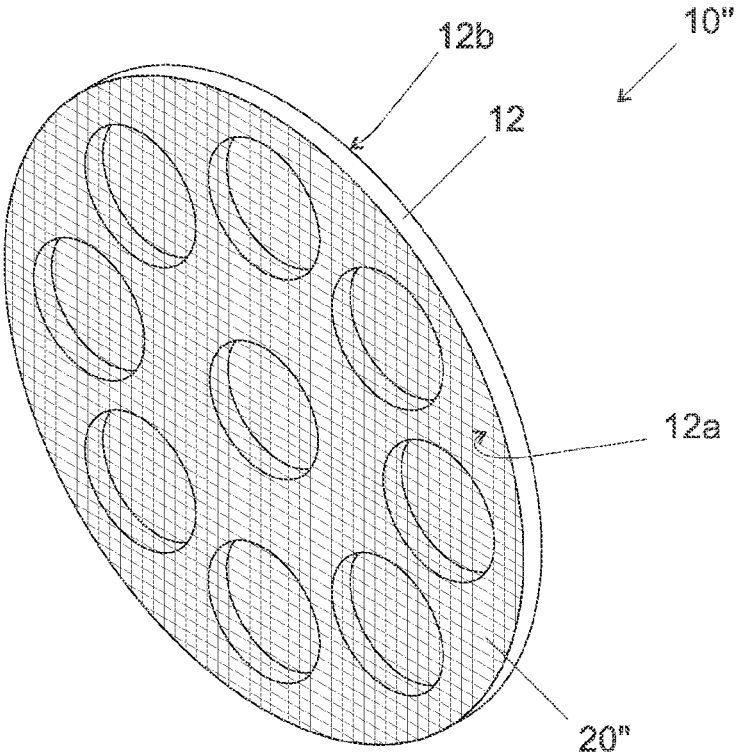
FIG. 10 illustrates a loading assembly according to a third embodiment.

In the case of the loading assembly 10" illustrated in FIG. 10, the film is formed directly on the first side 12*a* of the part holder 12: to this end, the spraying of a liquid solution onto the first side 12*a* of the part holder 12, followed by drying, these operations optionally being repeated several times, results in the formation of a perforated film 20" in the form of interlaced filaments or a net of filaments. The aforementioned water-soluble materials can be used, together with other solutions, water-based or otherwise: for example, in a non-limiting manner, a solution of sugar, salt, milk, organic matter (garlic, etc.), that makes it possible to form such a film after drying, can be used.

FIGS. 2 to 5 show the steps of loading methods and treatment methods according to the invention. For these methods, a loading assembly or assemblies 10, 10' or 10" as described above is/are used.

Figure 2A:
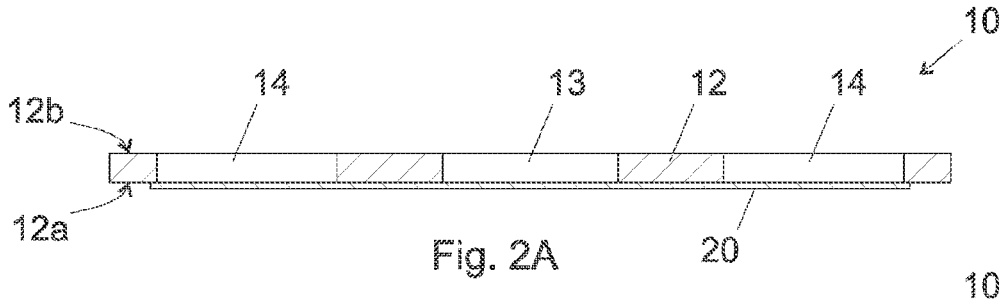
FIG. 2A shows a cross-section of the loading assembly and FIGS. 2B to 2E illustrate the steps for implementing a loading method and the treatment method according to the invention in a double-side machine.
Figure 2B:
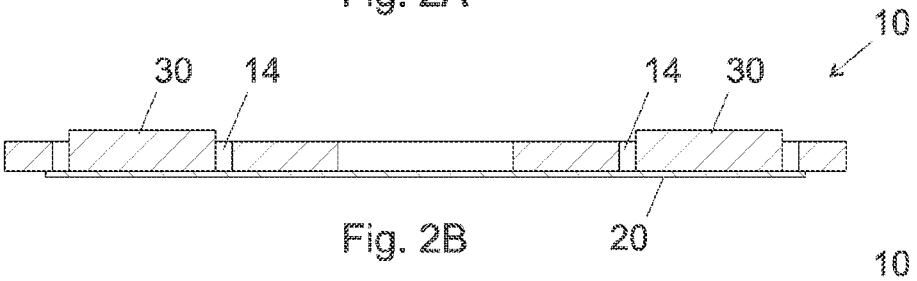

FIGS. 2A to 2E represent the situation of a double-side machine with dry destruction of the film 20 during the start of the treatment. For the loading method, the loading assembly 10 (film 20 mounted on the first side of the part holder 12) is supplied (FIG. 2A). Then, as shown in FIG. 2B, the parts 30 are arranged in the cells 14. FIG. 2B shows one part 30 per cell 14, but it can be envisaged that two or more parts 30 be positioned per cell 14. A loading assembly 10 loaded with parts is thus obtained, which can be stored and kept on standby until the time of loading and treatment in the machine.

These parts 30 are arranged on the film 20, which forms a support for the parts: the part holder 12 can therefore be taken or grasped without losing the parts 30. According to a first option corresponding to FIGS. 2 to 5, the parts 30 have been placed on the film 20 situated underneath the first side 12*a* of the part holder, which in this case forms a lower side of the part holder 12. The storage and handling of the part holders loaded with parts 30 must maintain this position with the film 20 underneath, and the parts can move in the cell 14 by sliding on the film. According to a second option, corresponding to FIGS. 6 to 8, one side of the part 30 is fixed to the film 20, for example by adhesive bonding, and there is no risk of the parts falling out during handling. If a water-soluble film is used, one fixing solution consists of moistening one side of the part, which will "stick" to the film 20. In this case, the parts 30 are (temporarily) fixed to the part holder 12 by means of the film 20 and, in this case, the part holder assembly with film and parts can be loaded on the machine, with the film 20 arranged on the top or on the bottom of this assembly.

Figure 2C:
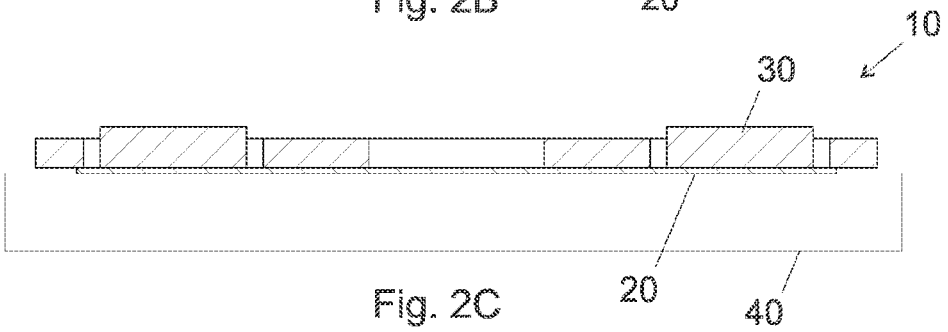

In the case of FIG. 2, next, the loading assembly 10 (the part holder 12 covered with the film 20) loaded with parts 30 (FIG. 2B) is arranged directly on the lower plate 40 of a double-side treatment machine (FIG. 2C). In this configuration, the parts 30 still rest on the film 20, in turn resting on the upper side of the lower plate 40 of the machine. The loading method is finished; it can be completed to perform a full treatment method.

Figure 2D:
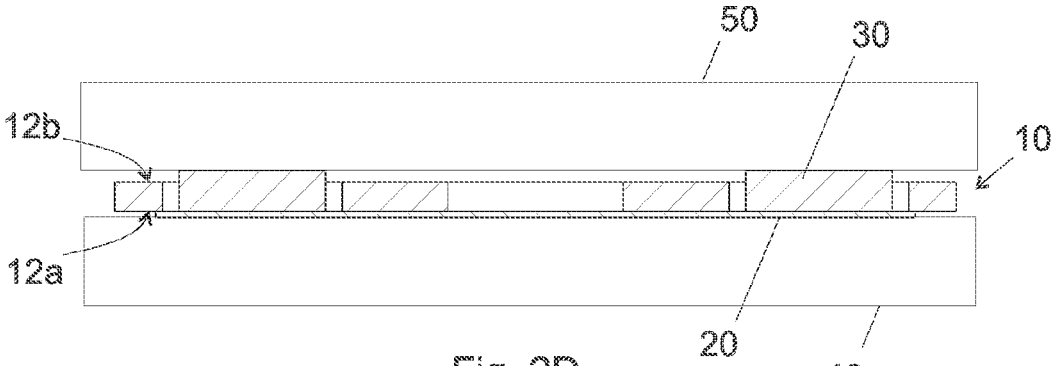

To this end, as can be seen in FIG. 2D, the upper plate 50 is lowered onto the part holder(s) 12 in order to close the treatment machine. The treatment then starts by the setting in motion of the lower plate 40 or the upper plate 50 or both the lower 40 and upper 50 plates relative to the base of the machine (not shown). Such movement is represented by the arrows 41 (lower plate) and 52 (upper plate), and remains in the plane of the plate in question. This movement can tier example be an alternating back-and-forth straight translational movement, or a rotating movement of the plate, or a combination of these movements. This movement of the plate or plates 40 and 50 is optionally accompanied by the movement of the parts 30 in their cells 14: either the part holders 12 (and therefore the parts 30) are immobile relative to the plate 40 (or 50), or the part holders 12 (and therefore the parts 30) are mobile relative to the plate 40 (or 50).

There are two phases during this treatment: in a first phase corresponding to the start of the treatment, the friction of the lower plate 40 against the film 20 arranged on it breaks down the film 20, which is transformed into particles, in principle non-abrasive, that are naturally discharged from the machine during the subsequent treatment. This is in particular friction between the lower plate 40 and the film 20 without any other addition of material or lubricant, in particular dry friction (unless the film produces lubricating particles when it breaks down). It must be noted that during this first phase, there is the normal contact between the lower side of the upper plate 50 and the upper side of the parts 30. After the film has been eliminated (see FIG. 2E), the treatment continues according to a second phase, still under the influence of the aforementioned movement, and the parts 30 now in contact through their lower side directly against the upper side of the lower plate 40, undergo the planned treatment on the machine, due to the two plates 40 and 50.

During these two phases of the treatment step, the speeds of the movements of the plates 40 and 50 and the pressure thereof, and all of the other machine parameters, are adjusted as required.

The unloading of the parts from the treatment machine is not illustrated, but is carried out as in the prior art. By way of example, once the treatment machine has been opened by raising the upper plate 50, the part holder(s) 12 is/are removed by hand and the treated parts are slid off the lower plate 40 into a storage container, for example pending another operation on these parts (another treatment operation in the sense of the present invention, or another machining, cutting, mounting, etc. operation).

Figure 2E:
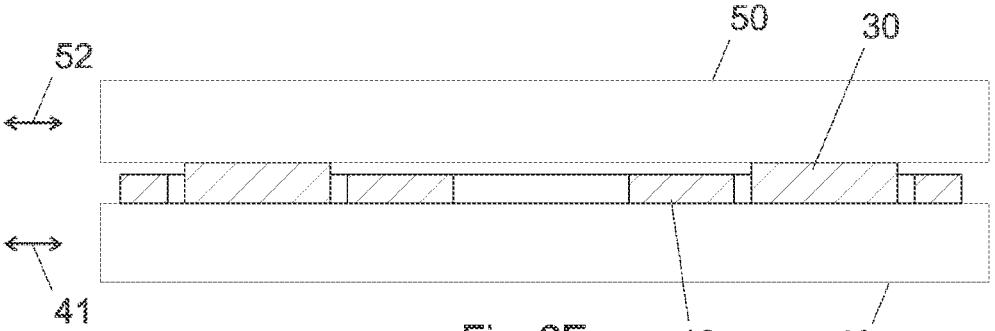

In FIGS. 2C to 2E, the lower plate 40 is shown as coinciding with the size of the part holder, but in reality and in most cases, it is possible for several part holders 12 to rest simultaneously on a treatment machine lower plate.

Figure 3A:
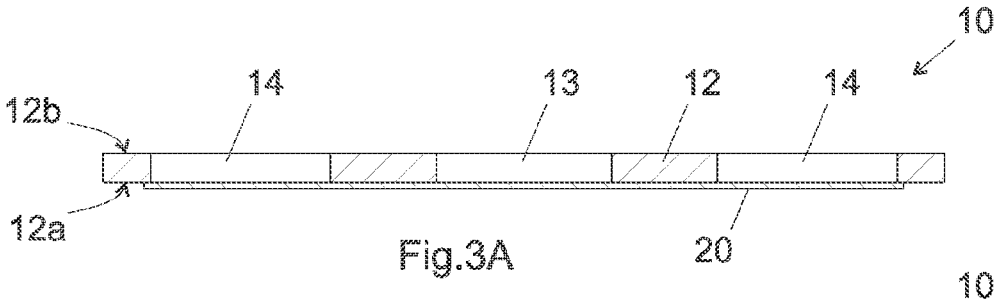
FIG. 3A shows a cross-section of the loading assembly and FIGS. 3B to 3E illustrate the steps for implementing a loading method and the treatment method according to the invention in a double-side machine using a liquid abrasive suspension.
Figure 3B:
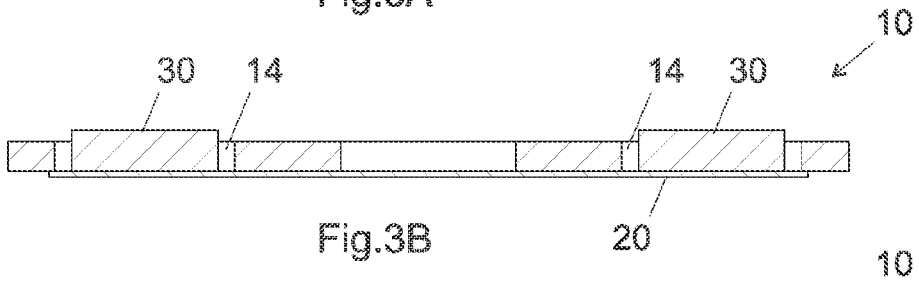
Figure 3C:
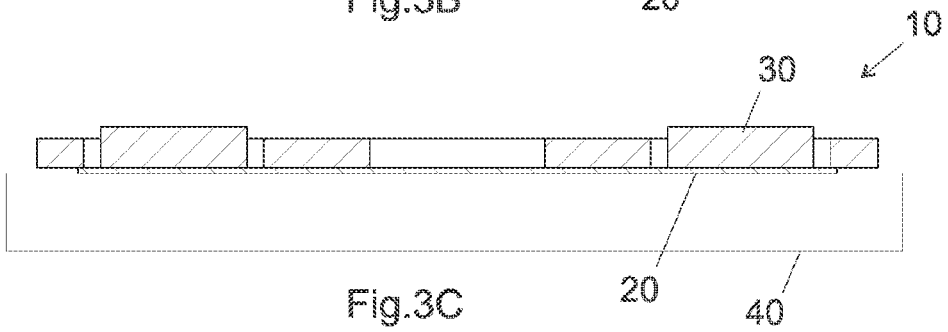
Figure 3D:
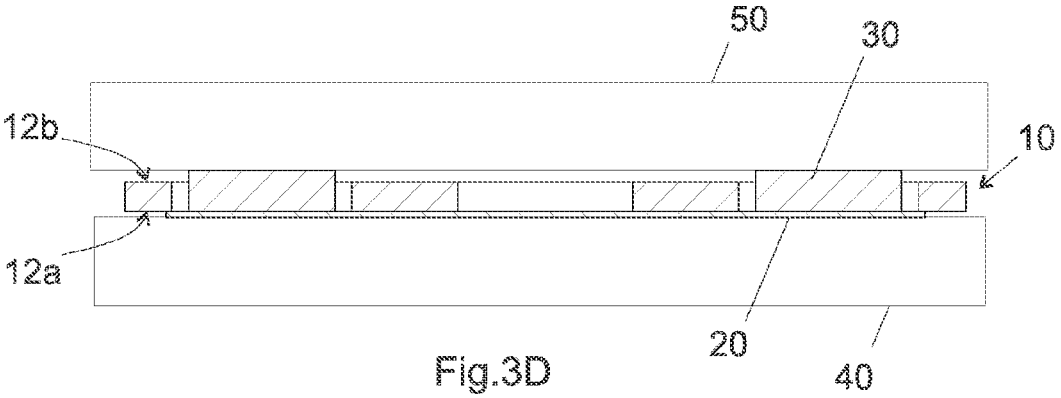
Figure 3E:
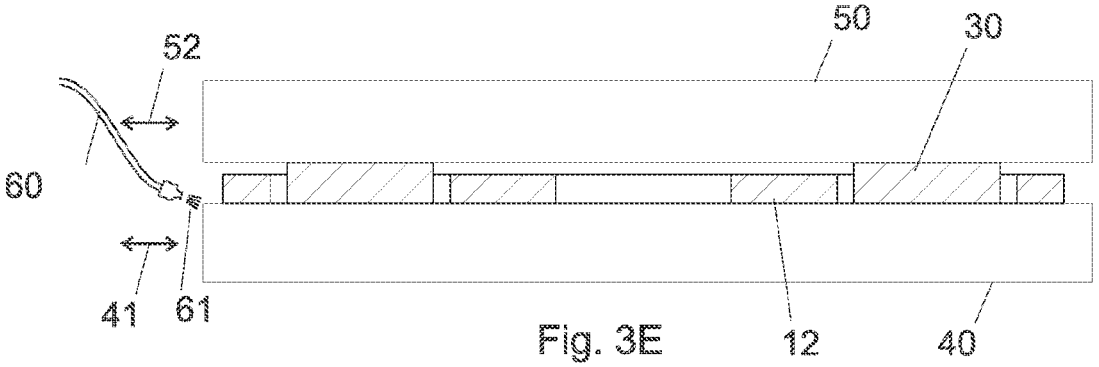

Reference is now made to FIGS. 3A to 3E: in this case, the situation is represented of a double-side machine with destruction of the film 20 by dissolving during the start of the treatment, via a liquid in the form of an abrasive suspension (water-based or oil-based). It is a double-side machine with liquid treatment of the parts. In this case, FIGS. 3A to 3D correspond respectively to similar situations to those described above with reference to FIGS. 2A to 2D. Next, as illustrated in FIG. 3E, the treatment is started, with the addition of a liquid 61 between the plates 40 and 50 (work space), particularly in the form of an abrasive suspension, which can in particular be hydrophilic or hydrophobic. By way of non-limiting example, a nozzle 61 is used to supply the liquid.

There are two phases during this treatment illustrated in FIG. 3E: in a first phase corresponding to the start of the treatment, the presence of the liquid 61 allows the dissolving of the film 20, which is transformed into particles, in principle non-abrasive, that are naturally discharged from the machine with the liquid during the subsequent treatment. It must be noted that during this first phase, there is the normal contact between the lower side of the upper plate 50 and the upper side of the parts 30. After the film has been eliminated (see FIG. 3E), the treatment continues according to a second phase, still under the influence of the aforementioned movement and the liquid 61, and the parts 30 now in contact through their lower side directly against the upper side of the lower plate 40, undergo the planned treatment on the machine, due to the two plates 40 and 50.

In the situations described with reference to FIGS. 2 and 3, the treatment machine is a double-side machine and includes a lower plate 40 and an upper plate 50 intended to come into contact respectively with the lower side and the upper side of said parts 30, at least one of said plates being mobile in the plane thereof, and the method according to the invention further includes the following step:

bringing the upper plate 50 into contact with said parts 30 after the mounting of the loading assembly.

Reference is now made to FIGS. 4A to 4D and 5A to 5D, which represent the situation of a single-side machine, and the steps of the loading method and the treatment method with this machine.

Figure 4A:
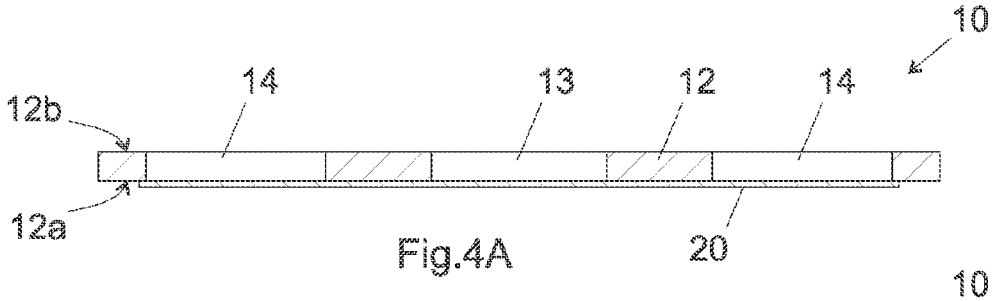
FIG. 4A shows a cross-section of the loading assembly and FIGS. 4B to 4D illustrate the steps for implementing a loading method and the treatment method according to the invention in a single-side machine.
Figure 4B:
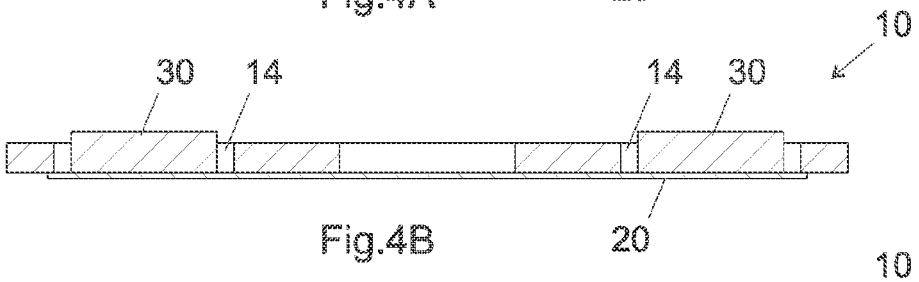
Figure 4C:
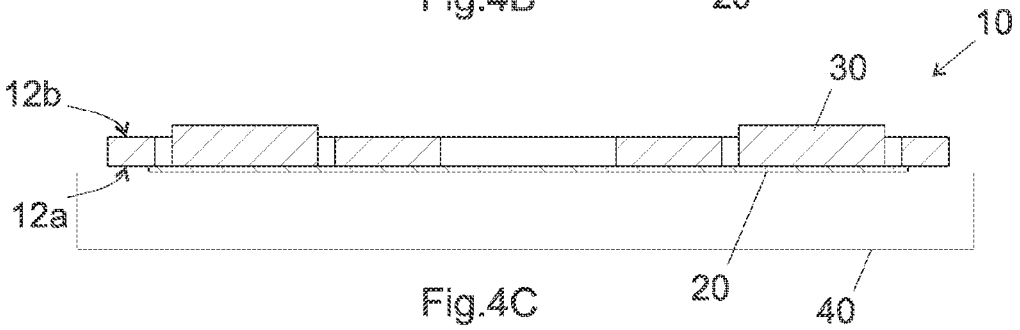
Figure 4D:
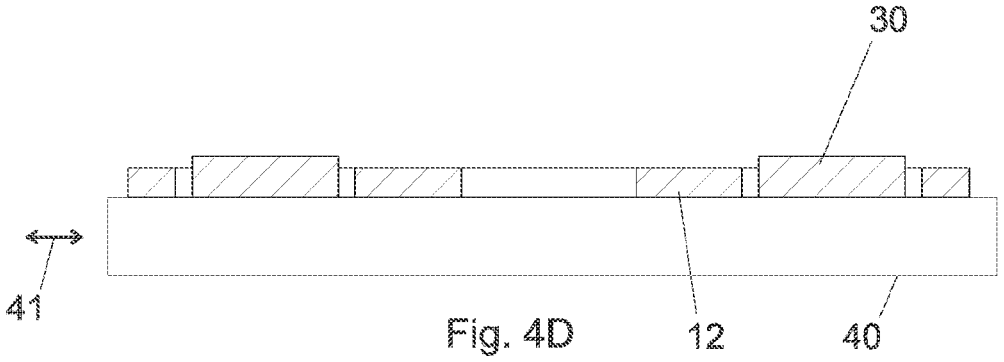

In the case of the loading and treatment methods illustrated in FIGS. 4A to 4D, as in the case of FIGS. 2A to 2E, no liquid is used for the treatment; the film 20 is destroyed dry during the start of the treatment. In this case, FIGS. 4A to 4C correspond respectively to similar situations to those described above with reference to FIGS. 2A to 2C, in FIG. 4C, the loading of the loading assembly 10 loaded with parts 30 is finished: the parts 30 are still resting on the film 20, in turn resting on the upper side of the lower plate 40 of the machine. In this case, as it is a single-side treatment machine, an upper plate is not used, Next, as illustrated in FIG. 4D, the treatment is started by setting the lower plate 40 in motion relative to the base of the machine (not shown). Such movement is represented by the arrow 41, and remains in the plane of the lower plate 40. This movement can fir example be an alternating back-and-forth straight translational movement, or a rotating movement of the plate, or a combination of these movements. This movement of the plate or plates 40 and 50 is optionally accompanied by a movement of the part holders 12 in their cell 14.

There are two phases during this treatment: in a first phase corresponding to the start of the treatment, the friction of the lower plate 40 against the film 20 arranged on it breaks down the film 20, which is transformed into particles, in principle non-abrasive, that are naturally discharged from the machine during the subsequent treatment. This is in particular friction between the lower plate 40 and the film 20 without any other addition of material or lubricant, in particular dry friction (unless the film produces lubricating particles when it breaks down). After the film has been eliminated (see FIG. 4D), the treatment continues according to a second phase, still under the influence of the aforementioned movement, and the parts 30 now in contact through their lower side directly against the upper side of the lower plate 40, undergo the planned treatment on the machine, due to the contact of the parts with the lower plate 40.

Figure 5A:
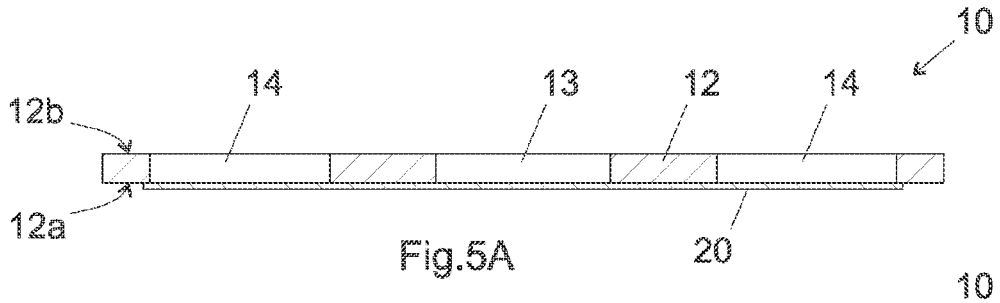
FIG. 5A shows a cross-section of the loading assembly and FIGS. 5B to 5D illustrate the steps for implementing a loading method and the treatment method according to the invention in a single-side machine using a liquid abrasive suspension.
Figure 5B:
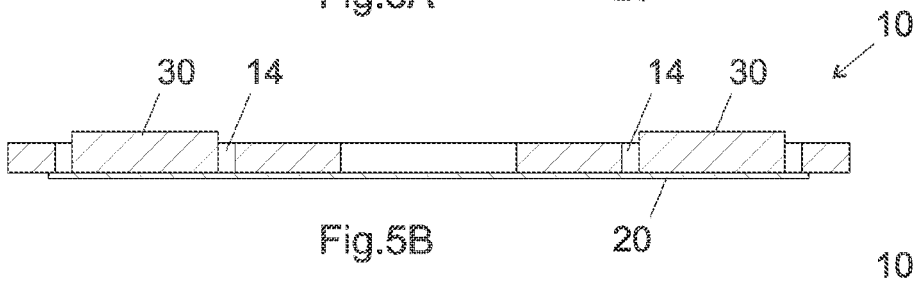
Figure 5C:
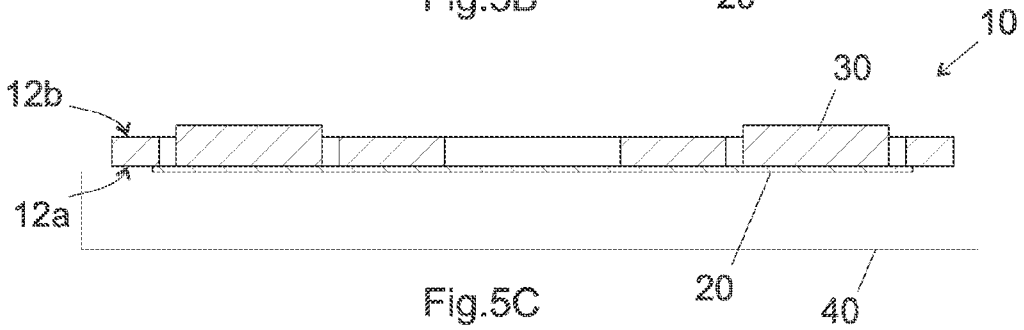
Figure 5D:
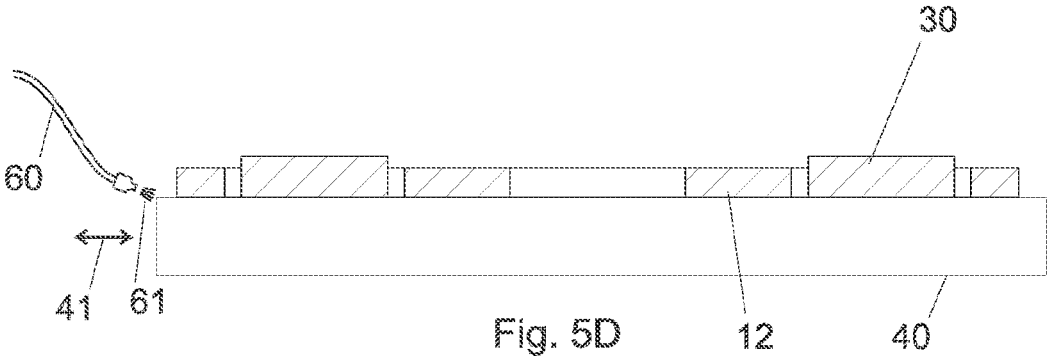

Reference is now made to FIGS. 5A to 5D: in this case, the situation is represented of a single-side machine with destruction of the film 20 by dissolving during the start of the treatment, via a liquid in the form of an abrasive suspension (water-based or oil-based). It is a single-side machine with treatment of the parts by liquid, particularly an abrasive suspension. In this case, FIGS. 5A to 5C correspond respectively to similar situations to those described above with reference to FIGS. 2A to 2C. Next, as illustrated in FIG. 5D, the treatment is started, with the addition of a liquid 61 above the plate 40 (work space), particularly in the form of an abrasive suspension, which can in particular be hydrophilic or hydrophobic. By way of non-limiting example, a nozzle 61 is used to supply the liquid.

There are two phases during this treatment illustrated in FIG. 5D: in a first phase corresponding to the start of the treatment, the presence of the liquid 61 allows the dissolving of the film 20, which is transformed into particles, in principle non-abrasive, that are naturally discharged from the machine with the liquid during the subsequent treatment. After the film has been eliminated (see FIG. 5D), the treatment continues according to a second phase, still under the influence of the aforementioned movement and the liquid 61, and the parts 30 now in contact through their lower side directly against the upper side of the lower plate 40, undergo the planned treatment on the machine, due to the contact and the movement of the plate 40.

Figure 6:
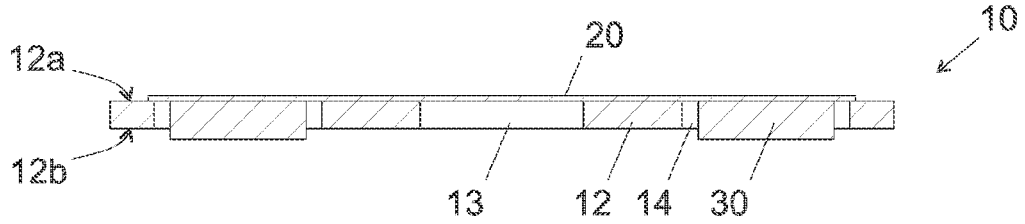
FIG. 6 shows a variant of the initial position of the loading assembly loaded with parts, with a view to implementing the loading method.
Figure 7:
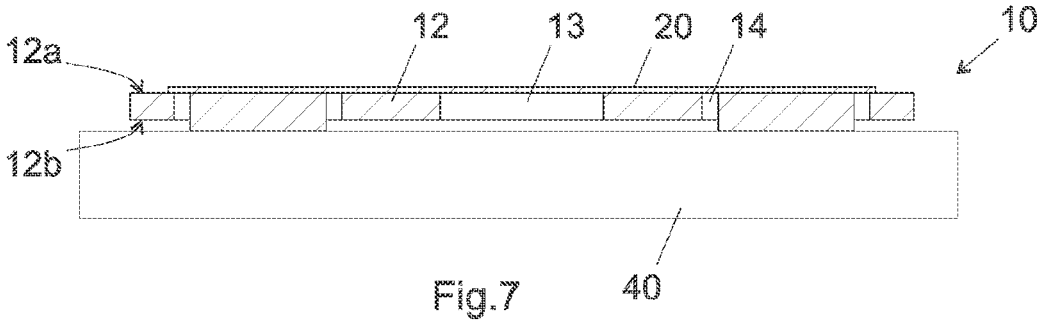
FIG. 7 shows a variant of mounting the loading assembly loaded with parts on the lower plate of a single-side or double-side machine.
Figure 8:
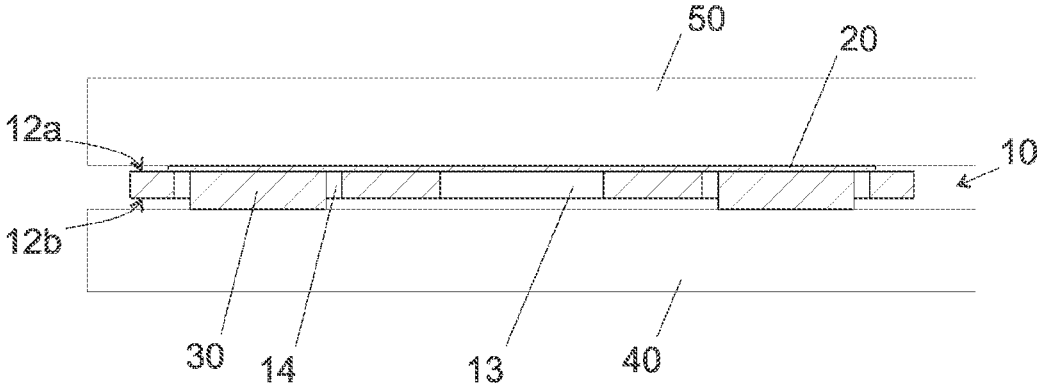
FIG. 8 shows a variant of mounting the loading assembly loaded with parts between the plates of a double-side machine.

Reference is now made to FIGS. 6 to 8, which show variants of the mounting of the loading assembly 10 loaded with parts 30 on the treatment machine. This is the situation described above in which not only is the film 20 bonded to the part holder 12, but the parts 30 are also fixed to the film 20. As a result, the loading assembly 10, 10' or 10" can be handled and loaded on the treatment machine with the film 20 facing upwards. The corresponding loading and treatment methods are those described above and illustrated with reference to FIGS. 2 to 5, with the exception of the differences described below. FIG. 6 shows the loading assembly 10 with the parts 30, therefore filled (as in FIGS. 2B, 3B, 4B, 5B).

FIG. 7 shows the case of this variant with the film 20 on top, once the loading assembly 10 loaded with parts 30 has been mounted on the lower plate 40 (as in FIGS. 2C, 3C, 4C, 5C), in this case the parts 30 are directly in contact with the lower plate 40 of the machine: thus, if it is a single-side machine, only the lower side of the parts is treated, and without friction between the film 20 and the machine plates, the film cannot be destroyed. In this case, it will be possible to remove the part holder 12 from the machine with the parts still secured to the loading assembly. Each part 30 must then simply be separated from the film after treatment.

FIG. 8 shows the case of this variant with the film 20 on top, once the loading assembly 10 loaded with parts 30 has been mounted on the lower plate 40 and the machine has been closed with an upper plate 50 (as in FIGS. 2D and 3D); in this case, the parts 30 are directly in contact with the lower plate 40 of the machine and the film 20 is in contact with the upper plate 50. It is thus a double-side machine and in this case, the friction between the film 20 and the upper plate of the machine (with or without the addition of liquid) will destroy the film.

In the situations described with reference to FIGS. 2, 3, 4 and 5, when the treatment of the parts 30 is started, in the treatment machine, the lower plate is set in motion parallel to the plane thereof, by which the friction of the lower plate on the film eliminates the film.

In the cases set out above (excluding the case of FIG. 7), when the treatment of said parts is started, the friction between the lower plate (upper in FIG. 8) of the machine and the film thus causes the destruction of the film.

In the cases set out above with reference to FIGS. 3 and 5, the film 20 is soluble and when the treatment of the parts 30 is started, a liquid 61 is also supplied in the treatment zone, by which the soluble film 20 is dissolved by the liquid 61 and the parts 30 directly come into contact with the lower plate 40.

In particular, the liquid can be just water, hot or cold, or an abrasive suspension. The abrasive particles can be varied and are those conventionally used, particularly diamond, silicon carbide (SiC), alumina (Al2O3), or cerium oxide powders, alone or as a mixture.

It will be understood that through the combination of the film 20 and the part holder 12, a loading assembly 10 is formed that makes it possible to hold the parts 30 in the part holder 12. It is therefore possible to prepare the loading assemblies 10 loaded with parts 30 in advance and store them, and then place them in the treatment machine. The time taken to load the machine is thus greatly reduced.

In a non-limiting manner, the parts 30 are intended for clockmaking, optics, microengineering, the automotive industry, aviation, etc.

In general, and in particular for the treatment method using a double-side machine, the parts 30 extend essentially in two dimensions, particularly with two flat sides parallel to each other. The term "flat" is used herein in the general geometrical sense, and roughness may exist. The term "parallel" is used herein in the general geometrical sense; a maximum possible relative inclination of the order of 5° may exist between the two sides in question.

REFERENCE NUMBERS USED IN THE FIGURES

10 Loading assembly
10' Loading assembly
10" Loading assembly
12 Part holder (planet gear)
12*a* First side of the part holder
12*b* Second side of the part holder
13 Central opening
14 Opening (cell)
16 outline
18 center
20 Film (continuous)
20" Film (perforated)
21 Film (limited)
22 Film (individual)
23 Film (individual)
30 parts
40 Lower plate
41 Arrow (lower plate movement)
50 Upper plate
52 Arrow (upper plate movement)
60 Nozzle or liquid supply
61 Liquid

The invention claimed is:

1. An assembly for loading parts to be treated in a single-side or double-side treatment machine comprising:

a part holder in the form of a plate for holding at least one part to be treated, comprising a second side and a first side, said first side being flat, and said part holder defining at least one through-hole forming a cell for accommodating at least one part to be treated, and a film mounted on the first side of the part holder opposite said through-hole and making it possible to hold said part to be treated at least during the loading step, said film being configured for being destroyed during the treatment by the treatment machine.

2. The loading assembly as claimed in claim 1, in which said film being configured for being destroyed by dissolving or by friction.

3. The loading assembly as claimed in claim 1, in which the part holder includes several cells and in which said film covers all of the cells.

4. The loading assembly as claimed in claim 1, in which the film is soluble, preferably water-soluble.

5. The loading assembly as claimed in claim 1, in which the part holder has a circular outline and a center.

6. The loading assembly as claimed in claim 5, in which the part holder is a planet gear comprising a toothed outline.

7. The loading assembly as claimed in claim 5, in which the part holder includes cells distributed evenly about the center.

8. The loading assembly as claimed in claim 1, in which said second side and said first side of the part holder are parallel to each other.

9. The loading assembly as claimed in claim 1, in which the film is water-soluble.

10. A method for loading parts to be treated in a single-side or double-side machine for treating parts that includes at least one lower plate intended to come into contact with the lower side of said parts, comprising the following steps:

providing a part holder in the form of a plate, comprising a second side and a first side, said first side being flat, and said part holder defining at least one through-hole forming a cell for accommodating one or more part(s) to be treated, mounting a film on the first side of the part holder opposite said through-hole, by which the film remains affixed to the part holder, said film being configured for being destroyed during the treatment by the treatment machine, placing the parts to be treated in said opening or openings, on said film, by which a loading assembly loaded with parts is formed, and mounting said loading assembly loaded with parts directly on the lower plate of the treatment machine.

11. The loading method as claimed in claim 10, in which the part holder includes several cells and in which said film covers all of the cells.

12. The loading method as claimed in claim 9, in which said film is soluble.

13. The loading method as claimed in claim 10, in which the part holder has a circular outline and a center and in which the part holder is a planet gear comprising a toothed outline.

14. The loading method as claimed in claim 10, in which said film is water-soluble.

15. A method for treating parts in a single-side or double-side treatment machine, comprising the loading method as claimed in claim 9, in which, during the step of mounting said loading assembly loaded with parts directly on the lower plate of the treatment machine, the first side of the part holder is placed on the lower plate so that the film is in contact with the lower plate, and further comprising the step of treatment of said parts with said treatment machine, by which, during the starting of the treatment, the film is eliminated through friction between the film and the lower plate of the treatment machine in contact with the film, and wherein the parts directly come into contact with the lower plate during the end of the treatment.

16. The treatment method as claimed in claim 15, in which the treatment machine is a double-side treatment machine which includes a lower plate and an upper plate intended to come into contact respectively with the lower side and the upper side of said parts, wherein after the mounting of said loading assembly loaded with parts on the lower plate of the treatment machine, the upper plate is brought into contact with said parts, wherein at least one of said plates being mobile in the plane thereof during the treatment, and wherein, when the treatment of said parts is started, the friction between the lower plate of the machine and the film causes the destruction of the film, by which the film is dissolved by a liquid and the parts directly come into contact with the lower plate during the end of the treatment.

17. The treatment method as claimed in claim 15, in which, when the treatment of the parts is started, the lower plate is set in motion parallel to the plane thereof, by which the friction of the lower plate on the film eliminates the film.

18. The treatment method as claimed in claim 15, in which said film is soluble and in which, when the treatment of the parts is started, a liquid is also applied in a treatment zone, by which the soluble film is dissolved by the liquid and the parts directly come into contact with the lower plate.

19. The treatment method as claimed in claim 18, in which the liquid is water-based and the film is water-soluble.

20. The treatment method as claimed in claim 18, in which the liquid is oil-based and the film is oil-soluble.

21. The treatment method as claimed in claim 15, in which said liquid is an abrasive suspension.

22. The treatment method as claimed in claim 15, in which said parts are intended for clockmaking, optics, microengineering, the automotive industry, aviation.

* * * * *